United States Patent [19]

Yih et al.

[11] 4,139,374

[45] Feb. 13, 1979

[54] CEMENTED CARBIDES CONTAINING HEXAGONAL MOLYBDENUM

[75] Inventors: Stephen W. H. Yih; Samuel A. Worcester, Jr., both of Albany; Erwin Rudy, Beaverton, all of Oreg.

[73] Assignee: Teledyne Industries, Inc., Los Angeles, Calif.

[21] Appl. No.: 733,533

[22] Filed: Oct. 18, 1976

Related U.S. Application Data

[62] Division of Ser. No. 581,787, May 29, 1975, Pat. No. 4,049,380.

[51] Int. Cl.[2] ..... C22C 29/00

[52] U.S. Cl. ..... 75/204; 75/203; 423/440

[58] Field of Search ..... 75/203, 204; 423/440

[56] References Cited

U.S. PATENT DOCUMENTS 3,479,155 11/1969 Rudy ..... 29/182.7

3,677,722 7/1972 Rymas ..... 29/182.8

FOREIGN PATENT DOCUMENTS 890757 3/1962 United Kingdom ..... 423/440

1326769 8/1973 United Kingdom ..... 423/440

OTHER PUBLICATIONS

Rudy, "Boundry Phase Stability . . .", Journal of Less Common Metals, vol. 33, #1, 10/73.

*Primary Examiner*—Brooks H. Hunt

*Attorney, Agent, or Firm*—Ronald W. Reagin

[57] ABSTRACT

A composition of material is disclosed which comprises sintered carbide-binder metal alloys. The carbide is a solid solution of hexagonal tungsten monocarbide and molybdenum monocarbide of stoichiometric composition containing between 10 and 100 mole percent molybdenum monocarbide. The binder is selected from the metals of the iron group, and comprises between 3 and 50 weight percent of the composition. A method for making the hexagonal carbide is also disclosed.

10 Claims, 12 Drawing Figures

CEMENTED CARBIDES CONTAINING HEXAGONAL MOLYBDENUM

This is a Division of application Ser. No. 581,787, filed May 29, 1975, now U.S. Pat. No. 4,049,580.

The present invention relates to cemented carbide alloys, in which part, or all, of the tungsten carbide in the alloys is replaced by molybdenum carbide. The resulting alloys equal those containing only tungsten carbide with regard to strength, hardness, and wear-resistance, but exhibit superior hot deformation resistance and grain growth stability during fabrication.

Those skilled in the art are familiar with many different compositions of cutting tools or the like in which tungsten carbide (WC), which is known to have a hexagonal crystal structure, is cemented either alone or when alloyed with other carbides such as titanium carbide, with a suitable binder material, typically an iron group metal, to form the desired cutting tool. However, it is also true that tungsten is a relatively expensive metal and that it is found in only a few parts of the world. Accordingly, it is considered to be a so-called "strategic" material, and its availability can be subject to political considerations.

These factors have caused the present applicants to seek a composition of material which could be functionally interchanged with the prior art tungsten carbide materials but in which all or a significant portion of the tungsten is exchanged for some other material which is not subject to these known disadvantages.

One area which the present applicants decided to investigate was the possibility of exchanging molybdenum for a significant portion or all of the tungsten in the carbide phase. This exchange, if it were possible, appeared attractive for several reasons. First, molybdenum is adjacent tungsten in the periodic table of elements, and sometimes forms compounds with other elements which are analagous to similar tungsten compounds and which have similar physical properties. Second, molybdenum is a relatively abundant and inexpensive metal. For example, at the present time molybdenum costs only about one-half as much as tungsten per unit weight. Since molybdenum has only about one-half the density of tungsten, the material for a cutting tool of comparable dimensions would cost only about one-fourth as much if molybdenum could be exchanged for tungsten. Thus, applicants determined to attempt to fabricate cutting tools containing significant amounts of hexagonal molybdenum carbide (MoC) exchanged for tungsten carbide and to determine if such compositions are of comparable cutting qualities.

However, numerous attempts in the prior art to synthesize the MoC analog to WC failed to yield homogeneous and defined products, so that even the existence of the hexagonal molybdenum monocarbide has remained in question to this date. See, for instance, R. Kieffer and F. Benesovsky: Hartstoffe und Hartmetalle, Wien, Springer, 1963; E. Rudy, S. Windisch, A. J. Stosick, and J. R. Hoffman: Trans. AIME 239 (1967), 1247; P. Ettmayer: Monatshefte f. Chemie 101 (1970), 1720. In an effort to stabilize MoC by tungsten carbide, W. Dawihl (Zeitschrift f. Anorganische Chemie 262 (1950), 212) found substantial homogenization in a mixture $(Mo_{.47}W_{.53})C$ at 2000° C., but found heterogeneous mixtures of tungsten carbide and subcarbide, $Mo_2C$, when the equilibration experiements were carried out at 1600° C. The inability to prepare single-phased monocarbides and the experienced instability of the solid solution in the presence of cobalt, as reported by W. Dawihl, ref. cited; R. Kieffer and F. Benesovsky, ref. cited, page 268, at the lower temperatures of 1350° to 1500° C. discouraged attempts to fabricate cemented carbides containing MoC. The alleged limited exchange of molybdenum for tungsten was confirmed in later investigations by H. J. Albert and J. T. Norton: Planseeber. Pulvermet. 4 (1956), 2. Thus, it has been accepted in the prior art that not more than 1–2% of the tungsten in WC could be exchanged with molybdenum, and that the solid solution (Mo,W)C or MoC did not exist in the desired temperature ranges 1200°–1900° C.

WC-$Mo_2C$-Ni(Co) and WC-$Mo_2C$-TiC-Ni(Co), containing only up to 1% Mo or Ti, have at times been investigated for steel cutting applications (R. Kieffer and F. Benesovsky: Hartmetalle, Wien, Springer, 1965), but exhibited poor toughness properties which compared with molybdenum-free grades with stoichiometric carbon balance. The additions of small quanities of molybdenum, or of $Mo_2C$, to the binder of tungsten carbide-based hard metal alloys is an accepted practice in the carbide industry to achieve a measure of grain growth stability of the alloys and to improve binder strength; the permissible amount of such additions, however, is limited by the solubility in the binder, since grossly understoichiometric compositions lead to the formation of the extremely brittle $\eta$-carbides ($M_6C$ or $M_{12}C$, where M represents the metal in the carbide), and even small amounts of excess $Mo_2C$ cause rapid deterioration of strength and hardness properties.

It is accordingly an object of the present invention to provide a composition of material based on solid solutions (Mo,W)C cemented with iron group metals, which have equal strength and hardness properties, but have better thermal deformation properties and grain growth stability than tungsten carbide grades with equivalent binder contents.

It is a further object of the present invention to provide a composition of material in which the molybdenum-tungsten monocarbides are further alloyed with other carbides, such as TiC, VC, TaC, NbC, and HfC, which, when combined with iron group metal binders, yield cemented tool materials which are particularly useful for machining steels.

It is another object of the present invention to provide a method by which MoC and single-phased (Mo,W)C solid solutions of any given ratio of molybdenum and tungsten can be fabricated.

Briefly stated, and in accordance with the presently preferred embodiment of the invention, a composition of material is provided which comprises sintered carbide-binder metal alloys. The carbide is a solid solution of hexagonal WC and MoC of stoichiometric composition containing between 10 and 100 mole percent MoC. The binder is selected from the metals of the iron group and from the additional group consisting of molybdenum, tungsten, chromium, copper, silver and aluminum. The iron group comprises between 3 and 50 weight percent of the composition and the additional group comprises between 0 and 10 weight percent of the composition.

In accordance with another aspect of the invention, the hexagonal (Mo,W)C can be alloyed with cubic carbides selected from the group consisting of TiC, TaC, VC, NbC and HfC, with the cubic carbide comprising up to 85% by weight of the carbide phase of the composition.

For a complete understanding of the invention together with an appreciation of its other objects and advantages, please see the following detailed description of the attached drawings, in which.

The gross composition of the carbide component is preferably expressed in relative mole fractions in the form $(M_xM'_{x'}M''_{x''}\ldots)C_z$, in which M, M', M'' . . . stand for the metal components, and the stoichiometry parameter z measures the number of gramatoms carbon per gramatom of the combined metal; the parameter z thus provides a measure of the stoichiometry of the carbide component and a value of z = 1 defines the stoichiometric monocarbide. x, x', x'' . . . are, respectively, the relative mole fractions (metal exchanges) of the metal constituents M, M', M'' . . . It is noted that 100.x defines mole percent $MC_z$ or mole percent $MC_z$-exchange, 100.x' mole percent $M'C_z$ or mole percent $M'C_z$-exchange, 100.x'' mole percent $M''C_z$ or mole percent $M''C_z$ exchange, etc.

This method of defining the overall composition of the carbide component is particularly useful in describing the concentration spaces of interstitial alloys and will be used, sometimes in conjunction with compositions given in weight percent of the individual components, throughout the remainder of this specification.

Figure 1:
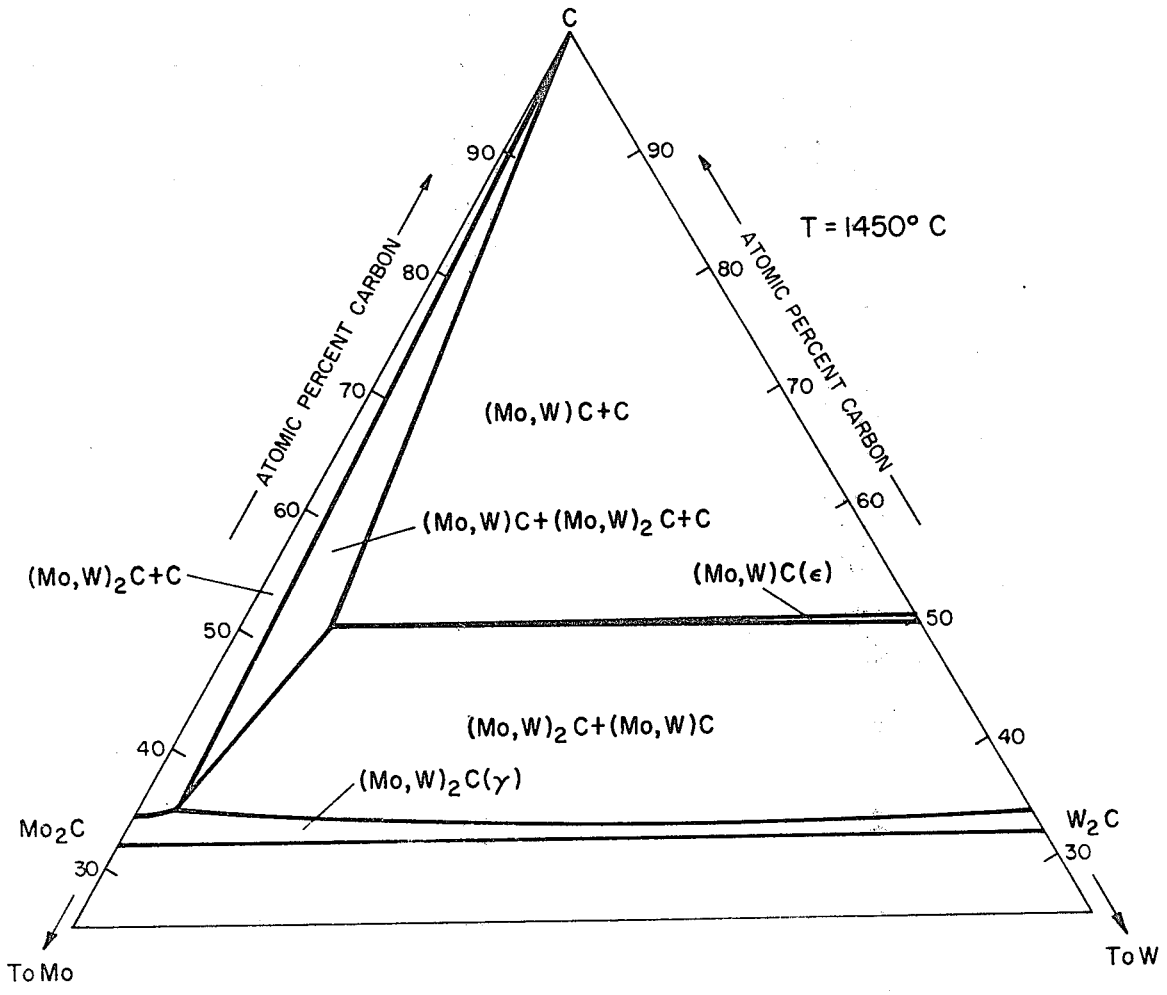
FIG. 1 is a revised partial phase diagram of the Mo-W-C system at 1450° C.
Figure 2:
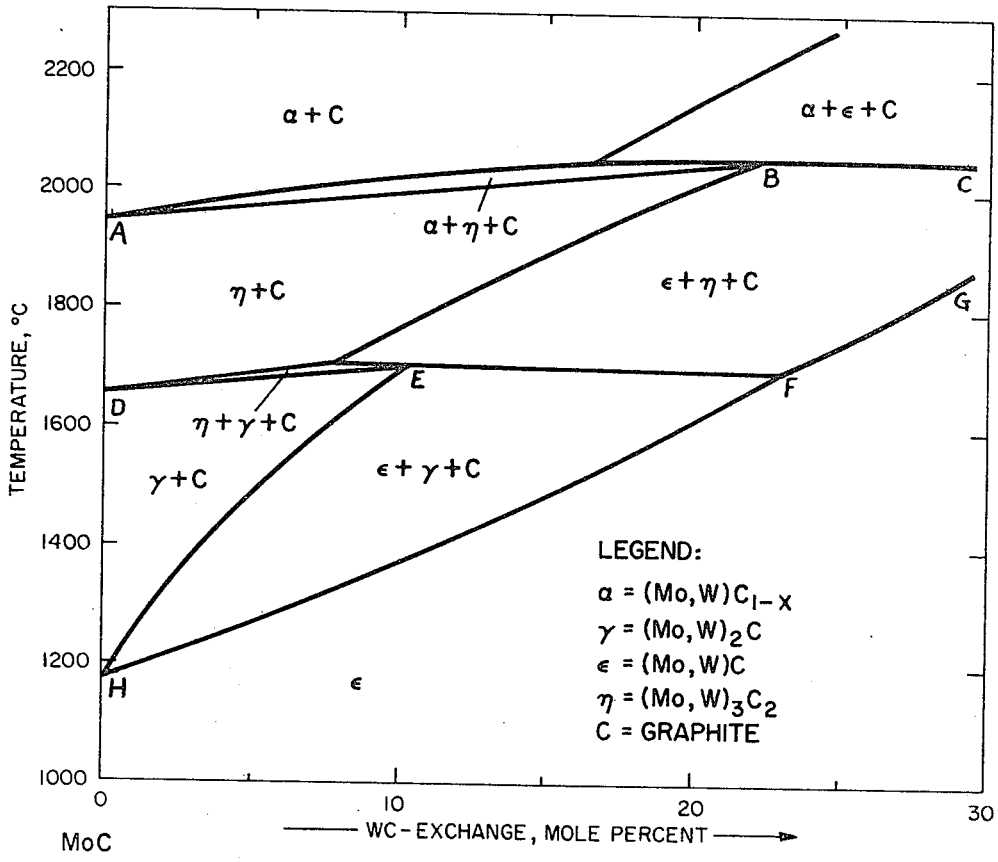
FIG. 2 is an isopleth of the Mo-W-C system along the section MoC-WC.

The basic alloying principles underlying the materials of the invention are demonstrated in FIGS. 1 and 2, which show, respectively, what the present applicants have determined to be the partial phase diagram of the Mo-W-C system at 1450° C. and a section of the system along the concentration line MoC-WC. It is seen from FIG. 2, that the pure binary MoC is stable only to 1180° C. and decomposes above this temperature to $Mo_2C$. and graphite. In the temperature section of the diagram at 1450° C., in FIG. 1, the monocarbide solid solution does therefore not extend to the binary system Mo-C. Substitution of molybdenum by tungsten, however, increases the phase stability limits to higher temperatures. As an example, according to FIG. 2, substitution of 10 mole percent tungsten carbide in MoC will increase the stability of MoC sufficiently that the monocarbide can be heated at almost 1400° C. without decomposition. At 20 mole percent WC, the decomposition temperature is raised to 1600° C., and is extended to still higher temperatures as the tungsten content is further increased.

The phase diagram data shown in FIGS. 1 and 2, however, pertain to equilibrium conditions and yield no information concerning the rat at which given phases, or combination of phases, will form under certain conditions. Thus, for example, when mixtures of $Mo_2C$ and carbon, or of molybdenum and carbon, corresponding to the stoichiometry MoC composition are heated even for hundreds of hours at temperatures within the stability range of the hexagonal monocarbide, no detectable quantities of monocarbide are formed. $Mo_2C$ and carbon can coexist in metastable equilibrium, even in the presence of iron group metals, such as nickel and cobalt.

However, in accordance with one aspect of the present invention, a method has been developed by which stable hexagonal MoC can be formed from mixtures of $Mo_2C$ and carbon or molybdenum and carbon within feasible reaction times and temperatures. Referring again to FIG. 2, it has been discovered that nucleation of the hexagonal (Mo, W)C phase (labeled the $\epsilon$ phase in FIG. 2) occurs very rapidly from the cubic $(Mo,W)C_{1-x}$ phase (labeled the $\alpha$ phase in FIG. 2) and somewhat less rapidly, but still quickly enough for practical use, from the pseudocubic $(Mo,W)_3C_2$ phase (labeled the $\eta$ phase in FIG. 2). When these phases are then cooled to the equilibrium temperature required to form the hexagonal (Mo,W)C phase, the formation of the (Mo,W)C is considerably more rapid because of the short diffusion paths resulting from the finely distributed carbon resulting from the decomposition of these phases. FIG. 2 also shows the equilibrium temperature as a function of tungsten exchange, with this temperature, of course, being represented by the line forming the top boundary of the area defining the (Mo,W)C or $\epsilon$ region of the phase diagram.

Diffusion can further be aided by addition of up to 4 atomic percent of a diffusion aiding metal, such as an iron group metal, preferably nickel and cobalt, since exclusive use of iron tends to diminish the yield as a result of formation of intermediate carbides containing iron and molybdenum. The desired characteristics of the diffusion aiding metal are that it be liquid at the temperature, that it have good solubility of carbon and that it does not enter into the carbide reaction.

The preferred method, then, for fabricating hexagonal MoC or the solid solution (Mo,W)C is to heat an intimately blended mixture of the desired gross composition (which may be powdered molybdenum and tungsten metal and graphite, or a mixture of $Mo_2C$, WC and graphite for example), in the presence of small amounts (0.5 to 1.0% by weight) of nickel or cobalt, to a temperature at which nucleation of the hexagonal MoC phase (or $\epsilon$ phase of FIG. 2) begins. Preferably the mixture is heated to the stability domain of the cubic $(Mo,W)C_{1-x}$ phase (or $\alpha$ phase of FIG. 2). As FIG. 2 shows, this temperature is approximately 2000° C., and is a function of the amount of tungsten exchange. The lower temperature of the stability domain of this $\alpha$ phase as a function of tungsten exchange is represented by the line ABC of FIG. 2. However, such nucleation also occurs within the stability domain of the pseudocubic $(MoW)_3C_2$ phase (labeled the $\eta$ phase in FIG. 2). As FIG. 2 shows, the lower temperatures for this phase is approximately 1700° C. for tungsten exchanges of less than about 22%, and increases thereafter with tungsten exchange. The lower temperature of the stability domain of this $\eta$ phase as a function of tungsten exchange is represented by the line DEFG of FIG. 2. The temperature is then lowered to within the stability domain of the hexagonal MoC or (Mo,W)C solid solution, or beneath the line HFG of FIG. 2, and held at this temperature until the formation of the monocarbide is complete, which usually occurs in several hours.

A variation of this method consists of charging the comminuted product of the high temperature into a liquid metal bath and growing the monocarbide crystals to suitable size at the chosen temperature (menstruum process). The latter method is particularly suited for the preparation of monocarbide solid solutions containing more than 10 mole percent tungsten carbide because of the ready adaptability of the commercial nickel-bath process. Fabrication of solid solutions still richer in molybdenum, or of MoC, itself, require melting point-lowering additions to the bath, such as, for example, copper and tin, in order to bring the melting temperature of the bath metal to within stability range of the carbide.

A typical procedure for the fabrication of a solid solution $(Mo_{.85}W_{.15})C$ is as follows A powder mixture consisting of 71.52 wt% $Mo_2C$, 24.26 wt% WC, and 4.22 wt%C, to which is added approximately 1 wt% Co to aid diffusion, is thoroughly blended in ball mill jars, the blended mixture pressed into graphite containers and the mixture briefly heated under vacuum to 1750° C. At this stage the rather dense reaction cake consists of a mixture of partly reacted WC, $\eta$-molybdenum carbide, and small amounts of excess carbon. The temperature of the furnace is then lowered to 1360° C. and held for a minimum of 10 hours at this temperature. Because of the rapid and oriented growth of the hexagonal (Mo,W)C solid solution, the reaction cake starts to swell, leaving as final reaction product a loose, readily crushable agglomerate of solid solution crystals.

Figure 3:
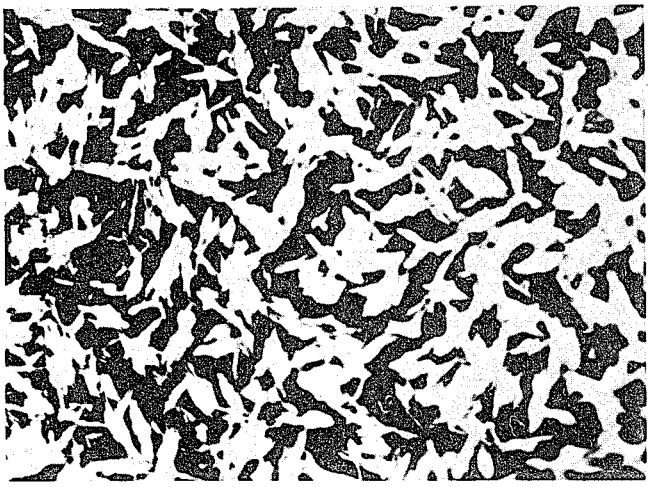
FIG. 3 is a micrograph, magnified 160 times, of a composition of material, showing the appearance of the $(Mo_{.85}W_{.15})C$ solid solution grains as in the as-homogenized condition.

FIG. 3 shows a micrograph, magnified 160 times, of the composition of material at this time, and shows the appearance of the solid solution grains in the homogenized condition.

Figure 4:
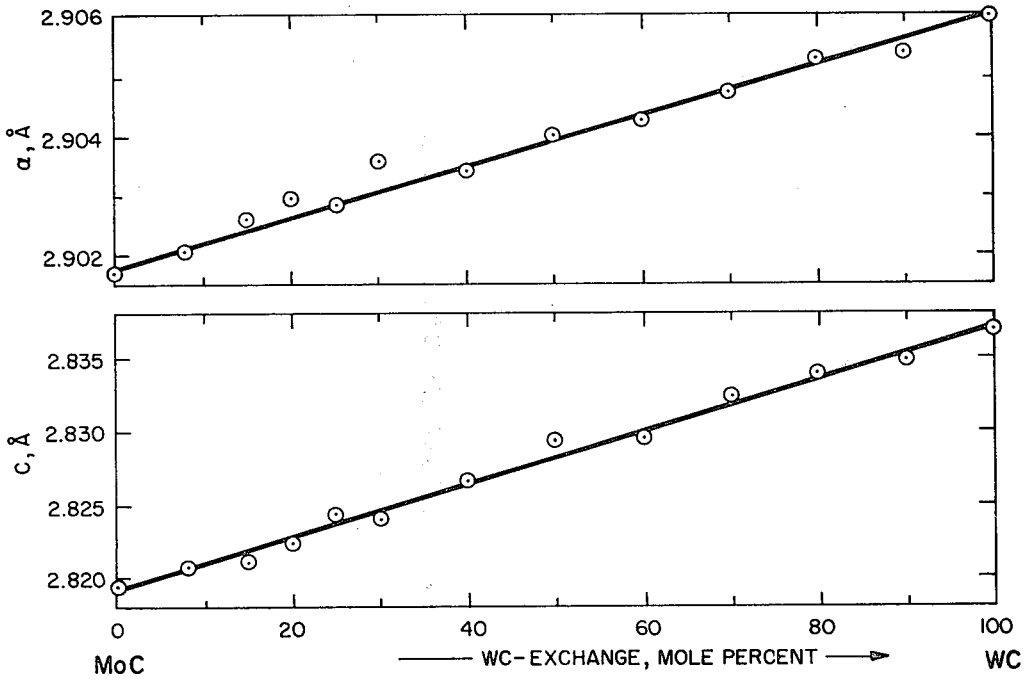
FIG. 4 shows the lattice parameters of the (Mo,W)C solid solution.

X-ray diffraction analysis showed the reaction product to be single phased, with unit cell dimensions of the tungsten carbidetype crystal lattice of a=2.9026Å and c=2.821Å. The solid solution prepared in this manner typically has a bound carbon content of 49.7 to 49.9 atomic percent. FIG. 4 is a graph showing the lattice parameters a and c as a function of tungsten exchanges.

Whatever variations in the details of the fabrication procedures are chosen, it is important to observe that the temperature stability limits of molybdenum-rich (Mo,W)C solid solutions are not to be exceeded in the presence of larger amounts (>4 percent by weight) of liquid iron group metals, because of the observed physical separation of carbon from $Mo_2C$ by action of the melt, as well as the tendency of $Mo_2C$ to form large agglomerates, so that a recombination of the constituents to form a homogeneous monocarbide cannot be accomplished within feasible reaction times.

Aside from the routine fabrication variables, choice of the carbide ingredients, addition carbides, grain size distribution of the carbides, in particular the molybdenum-tungsten monocarbides, as well as milling and sintering conditions, strongly influence microstructure and phase constituents and, as a result, the properties of the sintered compacts.

In accordance with another aspect of the present invention, it has been discovered that cemented tool materials which are particularly useful for machining steels can be formed by alloying the above described hexagonal MoC and (Mo,W)C solid solutions with cubic carbides such as titanium carbide (TiC), vanadium carbide (VC), tantalum carbide (TaC), niobium carbide (NbC) and hafnium carbide (HfC), together with suitable binder metals. In this specification, compositions containing only hexagonal MoC or (Mo,W)C in the carbide phase are sometimes referred to as unalloyed compositions or grades, while compositions also containing one or more of the abovementioned cuibc carbides in the carbide phase are sometimes referred to as alloyed compositions or grades.

As is shown in the numerous examples set forth below, the proportion of the cubic carbides to the hexagonal carbides in the carbide phase of the alloyed grades can be up to 85% by weight of the carbide phase.

Figure 5:
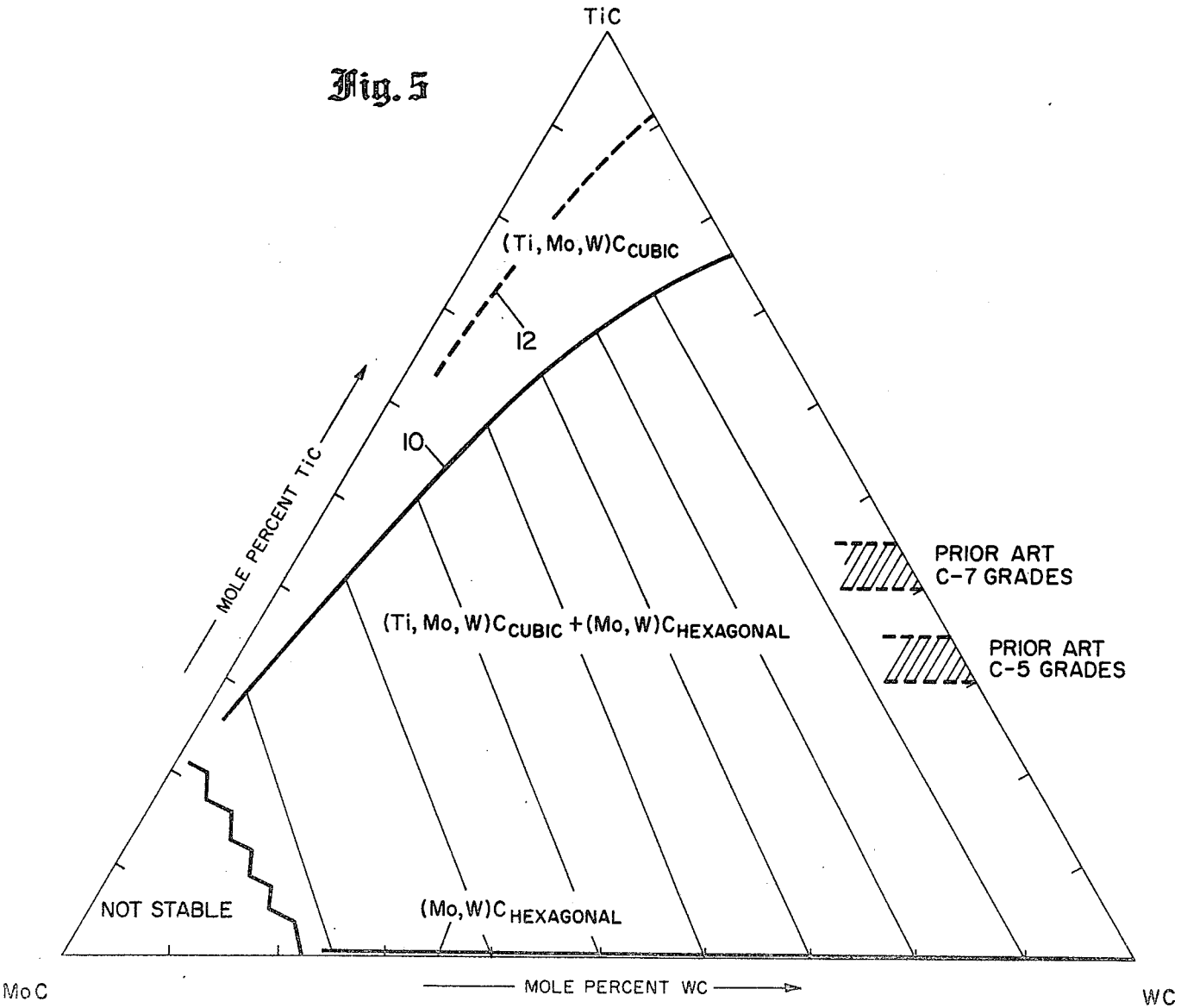
FIG. 5 is a phase diagram of the pseudoternary system TiC-MoC-WC at 1450° C.

FIG. 5 shows the phase diagram for the pseudoternary system TiC-MoC-WC at 1450° C. The solubility line 10 depicts the maximum solubility of the hexagonal carbides in the cubic carbides as a function of molybdenum content in the hexagonal carbide. The line 12 represents the approximate solvus line for TaC-MoC-WC at 1450° C. FIG. 5 also shows the composition of some of the prior art C-5 and C-7 grade tools, which are alloyed cubic TiC and hexagonal WC sometimes containing several atomic percent molybdenum.

In preparing cemented carbides containing no further carbides besides (Mo,W)C (unalloyed grades), it should be noted that the increasingly lower thermodynamic stability of the monocarbide solution with increasing molybdenum content causes higher solubilities of the carbide in the binder and thus a higher binder hardness than observed with tungsten carbide. In order to achieve comparable toughness of the molybdenum-containing, sintered alloys, a somewhat larger grain size than with the corresponding tungsten carbide alloy should be selected.

Another important difference concerns the nature of the phases appearing at carbon-deficient compositions. Unlike the cemented tungsten carbide, in which the extremely brittle $\eta$-carbides ($W_6C$ or $W_{12}C$) appear above certain levels of carbon deficiencies, the corresponding equilibrium phase in molybdenum-rich (Mo,W)C solid solution is the subcarbide, $(Mo,W)_2C$. Although the embrittling effect of the subcarbide on the sintered alloy is less than that of the $\eta$-carbide, hardness and bending strength properties are adversely affected by its presence. Close attention to the proper carbon balance in the alloys as prepared in the hexagonal phase as well as during fabrication is thus necessary, and the formation of subcarbide films between the binder metal and the carbide in stoichiometric alloys can be circumvented by rapid cooling of the alloys following sintering. At higher binder levels, these effects are less pronounced and a certain variability in the carbon stoichiometry can be tolerated without incurring degradation of the essential properties of the sintered materials. In the alloyed grades, in particular those high in TiC and other addition carbides, sensitivity to form $M_2C$ carbides at substoichiometric compositions is less than in the unalloyed grades, as behavior which is mainly attributable to the large extent of the homogeneity range of the cubic carbides towards carbon-deficient compositions. It should be noted, however, that improper alloying and fabrication techniques of steel-cutting grades deficient in carbon can result in undesirable transport phenomena during sintering, leading to an enrichment of the hexagonal carbide at the surface of the sintered parts and consequently to a decrease in wear-resistance of the surface zones.

The following tables and graphs show the performance of a large number of tools having different compositions within the range of the invention and also give comparison data for prior art tools designed for similar applications. The performance data for the unalloyed grades in comparison to cemented tungsten carbide in cutting steel are to serve only as guidelines for their wearresistance relative to tungsten carbides, since the main field of application of such alloys lies in other areas, such as for dies, wear parts, and mining tools.

Four different test conditions on 4340 steel were used. These are designated as Test Condition A, Test Condition B, Test Condition C, and Test Condition D. Where applicable, the test tool and the commercial comparison tool were run in alternate passes in order to eliminate effect from variations in the properties of the test steel bars. The test conditions referred to in the tables are as follows:

TEST CONDITION A (Wear Test, Unalloyed Grades) 4340 steel, $R_c$ 22 to 29; cutting speed 250 surface feet per minute; feed rate, 0.010" per revolution; depth of cut, 0.050", no coolant. SNG 443 or SNG 423 inserts.

TEST CONDITION B (Wear Test, Alloyed Grades) 4340 steel, $R_c$ 22 to 29; cutting speed 500 surface feet per minute; feed rate, 0.0152" per revolution; depth of cut, 0.050", no coolant. SNG 433 or SNG 423 inserts.

TEST CONDITION C (Thermal Deformtion Test, Unalloyed Grades)

4340 steel, $R_c$ 22 to 29; cutting speed 200 surface feet per minute; feed rate, 0.0522" per revolution; depth of cut, 0.050" no coolant. SNG 433 or SNG 423 inserts.

TEST CONDITION D (Thermal Deformation Test, Alloyed Grades)

4340 steel, $R_c$ 22 to 29; cutting speed 500 surface feet per minute; feed rate, 0.0457" per revolution; depth of cut 0.080"' no coolant. SNG 433 or SNG 423 inserts.

To obtain a comparative performance evaluation of the compositions of the invention, a cross section of representative tools from different manufacturers was also tested and the best performing tools selected as comparison standards. The comparisons of the commercial tools from the three different application categories also envisioned for the alloys of the invention are as follows:

| | Gross Composition |
|---|---|
| C-2 Grade | WC + 6 wt % Co |

-continued

| | Gross Composition |
|---|---|
| C-5 Grade | $(Ti_{.24}Ta_{.10}W_{.66})C$ + 8.5 wt % Co |
| C-7 Grade | $(Ti_{.33}Ta_{.10}W_{.57})C$ + 4.5 wt % Co |

The following examples, which are representative of some of the compositions of the present invention, describe in detail six specific compositions and the manner in which they were fabricated.

EXAMPLE 1 (UNALLOYED GRADE)

Gross Composition: 89.5 vol% $(Mo_{.8}W_{.2})C$ + 10.5 vol% Co.

A mixture consisting of 90.80 weight percent of a carbide powder $(Mo_{.8}W_{.2})C$ and 9.20 weight percent cobalt is milled for 60 to 95 hours in a stainless steel jar using ¼" diameter tungsten carbide balls and benzene as milling fluid. The milled powder slurry is dried, approximately 2 weight percent paraffine added as pressing aid, the mixture homogenized in a blender and isostatically pressed at 6000 psi, and the compacts granulated. The granulated material (150 to 600μ) is pressed at 15 tons per square inch into parts and dewaxed in a 3 hour cycle at 350° C. under vacuum. The dewaxed compacts are presintered for approximately 1 hour at 1150 to 1200° C. and sintered for 1 hour at 1370 to 1400° C. under vacuum or hydrogen. Dependent upon the chosen grain size, hardness of the sintered alloy can vary between about Rockwell A ($R_A$) 90 and 92.8 and the bending strength between about 290 and 230 ksi (ksi = thousand pounds per square inch).

Figure 6:
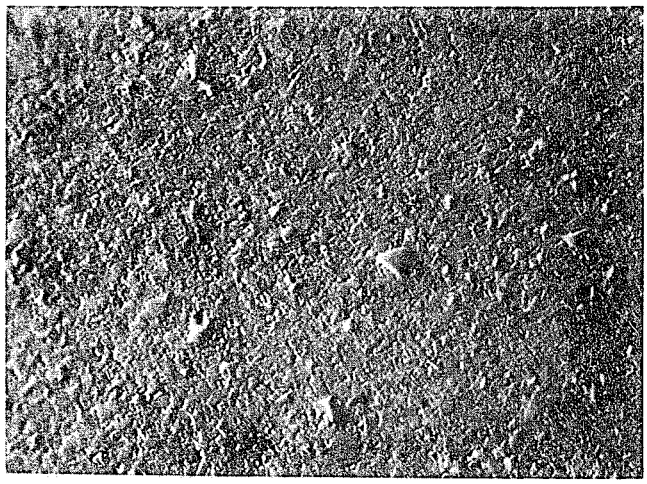
FIG. 6 is a micrograph, magnified 1000 times, of a composition of material showing the microstructure of a sintered solid solution $(Mo_{.8}W_{.2})C$ with 9.2 wt% cobalt binder
Figure 7:
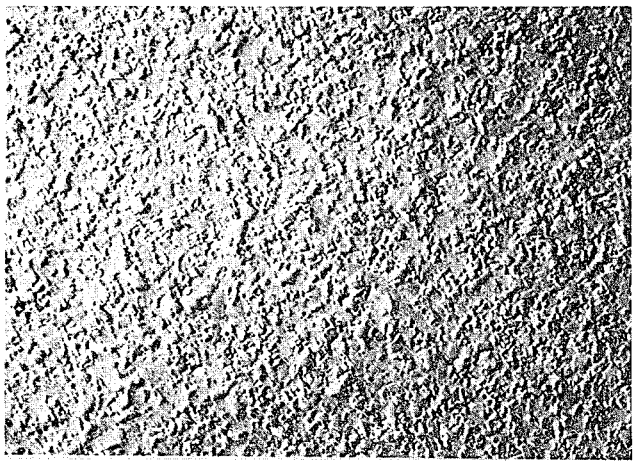
FIG. 7 is a micrograph, magnified 1000 times, of a composition of material showing the microstructure of a sintered cemented carbide having a gross composition $(Ti_{.23}Ta_{.10}W_{.37}Mo_{.30})C$ and 10% nickel binder.

FIG. 6 is a micrograph, magnified 1000 times, of the Example 1 just described. FIG. 7 is a micrograph, also magnified 1000 times, showing the microstructure of an alloyed grade of sintered cemented carbide having a gross composition $(Ti_{.23}Ta_{.10}W_{.37}Mo_{.30})C$ and 10% nickel binder. Those skilled in the art will appreciate that the appearance and microstructures shown are practically identical for the same prior art compositions containing entirely WC in the hexagonal phase.

EXAMPLE 2 (UNALLOYED GRADE)

Gross Composition: $(Mo_{.25}W_{.75})C$ + 10.5 vol% Ni

A mixture consisting of 93.50 weight percent carbide [39 weight percent powder $(Mo_{.8}W_{.2})C$, 61 weight percent tungsten carbide] and 6.50 weight percent nickel is ball milled and processed in the same manner as described under Example 1, and sintered for 1 hour at 1380° C. Dependent upon the chosen grain size and binder distribution, the hardness of the sintered alloy can vary between approximately $R_A$ 89 and 92 and the bending strength between approximately 200 and 265 ksi.

EXAMPLE 3 (UNALLOYED GRADE)

Gross Composition: $Mo_{.5}W_{.5})$ + 10.5 vol% (Co + Ni, 1:1)

A mixture consisting of 92.3 weight percent of a powder $(Mo_{.5}W_{.5})C$, 3.85 weight percent nickel, and 3.85 weight percent cobalt is ball milled and processed in the same manner as described under Example 1, and sintered for 1 hour at 1380° to 1400° C. Dependent upon the chosen grain size, hardness of the sintered alloy can vary between approximately $R_A$ 90 and 92 and the bending strength between approximately 230 and 290 ksi.

EXAMPLE 4 (ALLOYED GRADE C-5)

Gross Composition: $(Ti_{.24}Ta_{.10}Mo_{.16}W_{.50})C$ + 13 vol% Co

A mixture consisting of 90.4 weight percent of an alloy blend [21.04 weight percent $(Ti_{.6}Mo_{.4})C_{.98}$, 12.88 weight percent TaC and 66.08 weight percent WC] and 9.6 weight percent cobalt is ball milled and processed in the same manner as described under Example 1, and sintered for 1 hour at 1440° C. under vacuum. Dependent upon the chosen grain size, hardness of the sintered alloy can vary between approximately $R_A$ 91.4 and 92.6 and bending strength between approximately 210 and 240 ksi.

EXAMPLE 5 (ALLOYED GRADE C-7)

Gross Composition: $(Ti_{.33}Ta_{.10}Mo_{.24}W_{.33})C$ + 6.6 vol% Co

A mixture consisting of 94.5 weight percent of an alloy blend [50.30 weight percent $(Ti_{.49}Mo_{.36}Ta_{.15})C$ and 49.70 weight percent WC] and 5.5 weight percent cobalt is ball milled and processed in the same manner as described under Example 1 and sintered for 1 hour at 1465° C. under vacuum. Dependent upon the chosen grain size, hardness of the sintered alloy can vary between approximately $R_A$ 92.3 and 93.8 and the bending strength between approximately 170 and 210 ksi.

EXAMPLE 6 (ALLOYED GRADE C-5)

Gross Composition: $(Ti_{.25}W_{.25}Mo_{.45}Hf_{.025}Nb_{.025})C$ + 13 vol% (Ni,Mo)

A mixture consisting of 86.5 weight percent of an alloy blend [30.60 weight percent $(Ti_{.6}W_{.1}Mo_{.3})C$, 20.30 weight percent $(Mo_{.8}W_{.2})C$, 42.95 weight percent $(Mo_{.5}W_{.5})C$, and 16.5 weight percent $(Hf_{.5}Nb_{.5})C$], 10.5 weight percent nickel, and 3 weight percent molybdenum is ball milled and processed in the same manner as described under Example 1, and sintered for 1 hour at 1430° C. under vacuum. Dependent upon the chosen grain size, hardness of the sintered alloy can vary between approximately 91.9 and 92.6 and the bending strength between about 190 and 250 ksi.

Test results and performance data of alloy compositions described in these examples, of other tools in accordance with the invention, and selected prior art tools, when all subjected to the test conditions described above, are given in the following Tables 1 through 4, and FIGS. 8 through 12.

Figure 8:
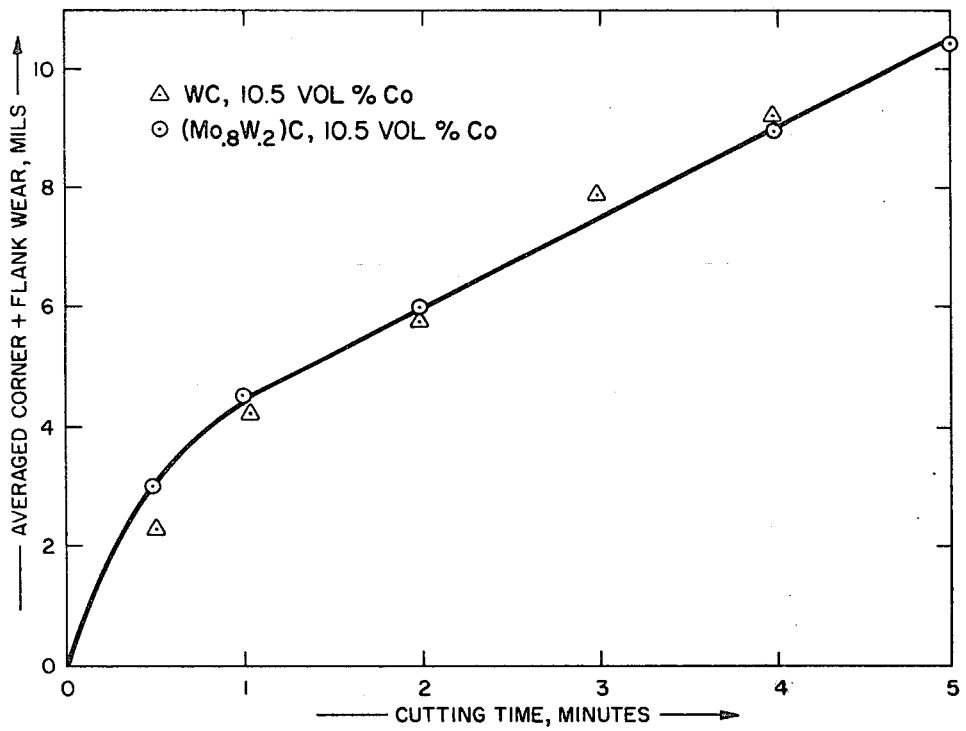
FIG. 8 are wear curves comparing the wear of a tool according to the present invention, and according to the prior art when subject to identical test conditions.

FIG. 8 shows the average corner and flank wear as a function of cutting time for a tool formed from the above Example 1 and the prior art C-2 carbide described before, when subjected to Test Condition A.

Figure 9:
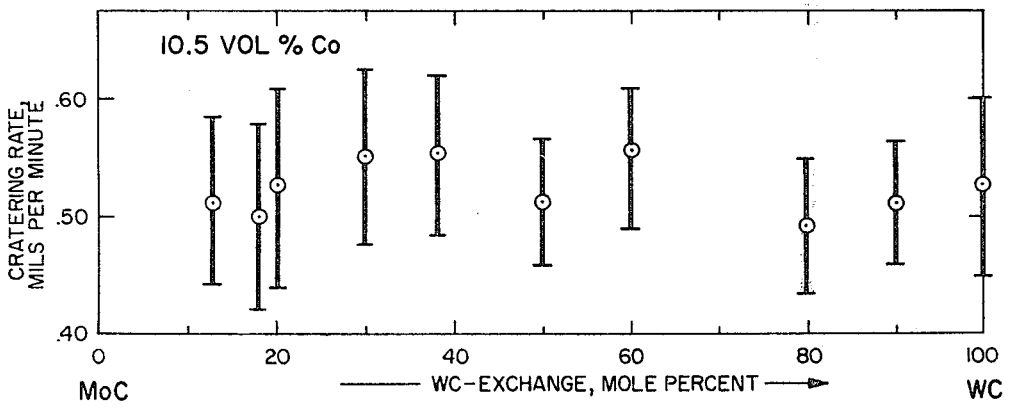
FIG. 9 is a graphical presentation of the cratering rate of tools in accordance with the present invention as a function of the tungsten carbide content.

FIG. 9 shows the cratering rates as a function of the tungsten carbide content in the (Mo,W) C solid solution of tools in accordance with the present invention and the prior art C-2 carbide described before, when subjected to Test Condition A, and illustrates that the cratering rate is independent of the tungsten exchange or molybdenum content of the tool.

Figure 10:
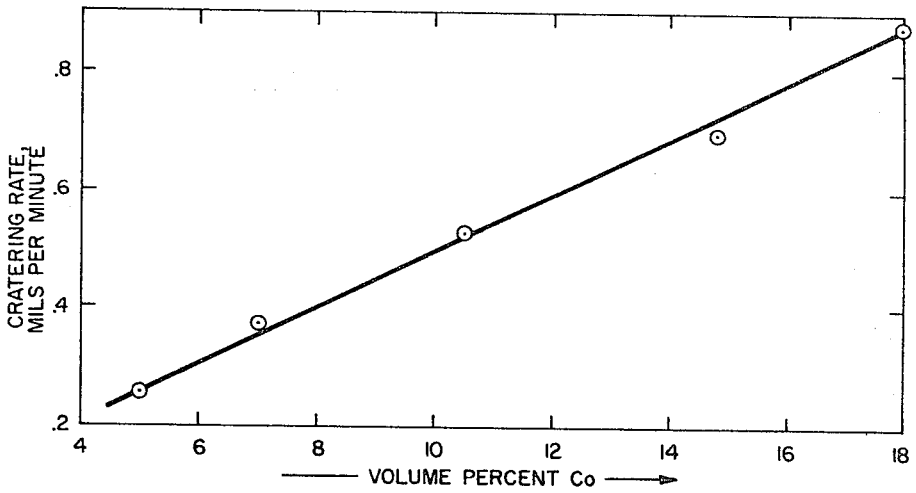
FIG. 10 is a graphical representation of the cratering rate of tools in accordance with the present invention as a function of the binder cement.

FIG. 10 shows the cratering rate of a carbide composition $(Mo_{.8}W_{.2})C$ in accordance with the present invention as a function of the cobalt content.

Table 1

Wear Pattern of the Tools Described in Examples 1 through 3 and of other Test Tools in Comparison to Commercial Sintered Tungsten Carbides. Test Condition A.

| Tool | Total Cutting Time, Minutes | Notch due to Crater Breakout | Corner Wear | Flank Wear | Scale Line | Crater Depth | Remarks |
|---|---|---|---|---|---|---|---|
| Example 1 | 5.0 | — | .010" | .011" | .014" | .0027" | Chip welding tendency |
| Example 2 | 4.5 | — | .010" | .010" | .014" | .0029" | Slight chip welding tendency |
| Example 3 | 4.0 | | .010" | .009" | .011" | .0024" | " |
| Tool A | 4.0 | — | .009" | .011" | .018" | .0035" | " |
| Tool B | 4.50 | — | .009" | .009" | .013" | .0017" | " |
| Tool C | 3.30 | — | .012" | .014" | .021- | .0043" | .0008"deform. at tip |
| Commercial C-2 Grade WC + 6 wt % Co | 4.0 | — | .009" | .009" | .011" | .0022" | Slight chip welding tendency |

Tool A: $(Mo_{.65}W_{.35})C$ + 16 wt % Co
Tool B: $(Mo_{.8}W_{.2})C$ + 6 wt % Co
Tool C: $(Mo_{.75}W_{.25})C$ + 25 wt % Co Table 2

Thermal Deformation Data of Tools Described in Examples 1 through 3 and of other Test Tools in Comparison to Tungsten Carbide Cemented with Cobalt. Test Condition C.

| Tool | Total Cutting Time, Minutes | Deformation at Corner Tip, Inches | Remarks |
|---|---|---|---|
| Example 1 | 1.00 | <.0003" | — |
| Example 2 | 1.00 | <.0003" | — |
| Example 3 | 1.00 | <.0003" | — |
| Tool D | 1.00 | .002" | Strong chip welding tendency |
| Tool E | 1.00 | .0039" | " |
| Tool F | 1.00 | .006" | " |
| WC + 6 wt % Co | 1.00 | <.0003" | — |
| WC + 10 wt % Co | 1.00 | .0023" | Strong chip welding tendency |
| WC + 14 wt % Co | .93 | .0065" | " |
| WC + 20 wt % Co | .13 | n.d. | Breakdown of cutting tip |

Tool D: $(Mo_{.8}W_{.2})C$ + 16 wt % Co
Tool E: $(Mo_{.8}W_{.2})C$ + 21 wt % Co
Tool F: $(Mo_{.8}W_{.2})C$ + 28 wt % Co Table 3

Wear Pattern of the Tools Described in Examples 4 through 6 and of other Test Tools in Comparison to Commercial Sintered Carbides. Test Condition B.

| Tool | Total Cutting Time, Minutes | Notch due to Crater Breakout | Corner Wear | Flank Wear | Scale Line | Crater Depth | Edge Deform | Remarks |
|---|---|---|---|---|---|---|---|---|
| Example 4 | 12.23 | .003" | .010" | .012" | .016" | .0066" | .0006" | — |
| Example 5 | 16.31 | — | .006" | .008" | .013" | .0048" | <.0003" | — |
| Example 6 | 9.80 | — | .006" | .007" | .009" | .0055" | <.0003" | — |
| Tool G | 14.10 | — | .007" | .009" | .013" | .0052" | <.0003" | — |
| Tool H | 13.06 | .007" | .015" | .007" | .026" | n.d. | .0018" | deformation |
| Tool I | 21.02 | .002" | .007" | .010" | .016" | .0046" | <.0003" | — |
| Commercial C-5 | 10.03 | .003" | .012" | .011" | .019" | .0071" | .0012" | deformation |
| Commercial C-7 | 19.30 | .002" | .006" | .008" | .014" | .0052" | <.0003" | — |

Tool G: $(Ti_{.24}Hf_{.05}Nb_{.05}W_{.50}M_{.16})C$ + 9.5 wt % Ni, 2 wt % Mo
Tool H: $(Ti_{.30}W_{.35}Mo_{.35})$ + 11 wt % Ni
Tool I: $(Ti_{.30}Nb_{.05}Hf_{.05}W_{.35}Mo_{.25})$, 5.5 Ni, 1 Mo Table 4

Thermal Deformation Data of the Tools Described in Examples 4 through 6 and other Test Tools in Comparison to Commercial Carbides Cemented with Cobalt. Test Condition D.

| Tool | Total Cutting Time, Minutes | Deformation at Corner Tip Inches | Remarks |
|---|---|---|---|
| Example 4 | .50 | .010" | — |
| Example 5 | .51 | .002" | — |
| Example 6 | .50 | .008" | Heavy deformation |
| Tool G | .50 | .007" | — |
| Tool I | .51 | .0012" | — |
| Commercial C-5 | .43 | <.025" | Corner breakdown |
| Commercial C-7 | .51 | .007" | — |

Figure 11:
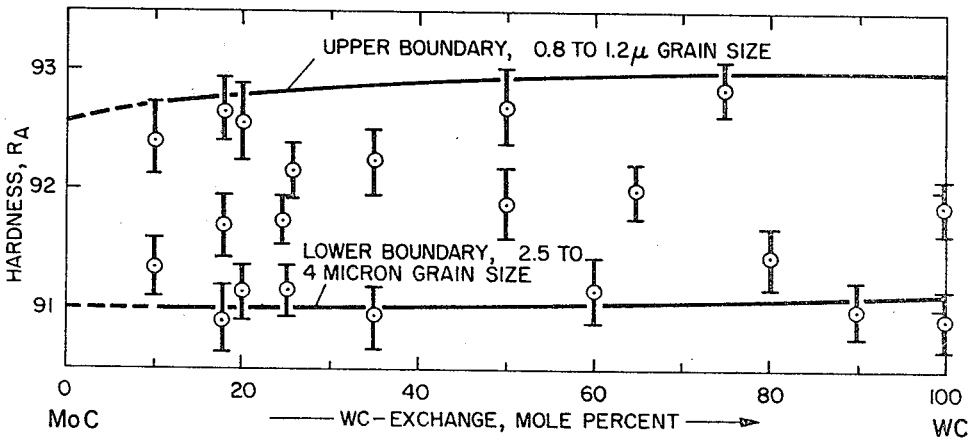
FIG. 11 is a graphical representation of the Rockwell A hardness of tools in accordance with the present invention as a function of the tungsten carbide content in the monocarbide solution.

FIG. 11 shows the Rockwell A hardness of (Mo,W)C solid solutions with 10.5 vol% Co in accordance with the present invention and of prior art tungsten carbide with the same volume percentage of cobalt, and illustrates that the hardness is independent of the tungsten exchange or molybdenum content of the tool.

Figure 12:
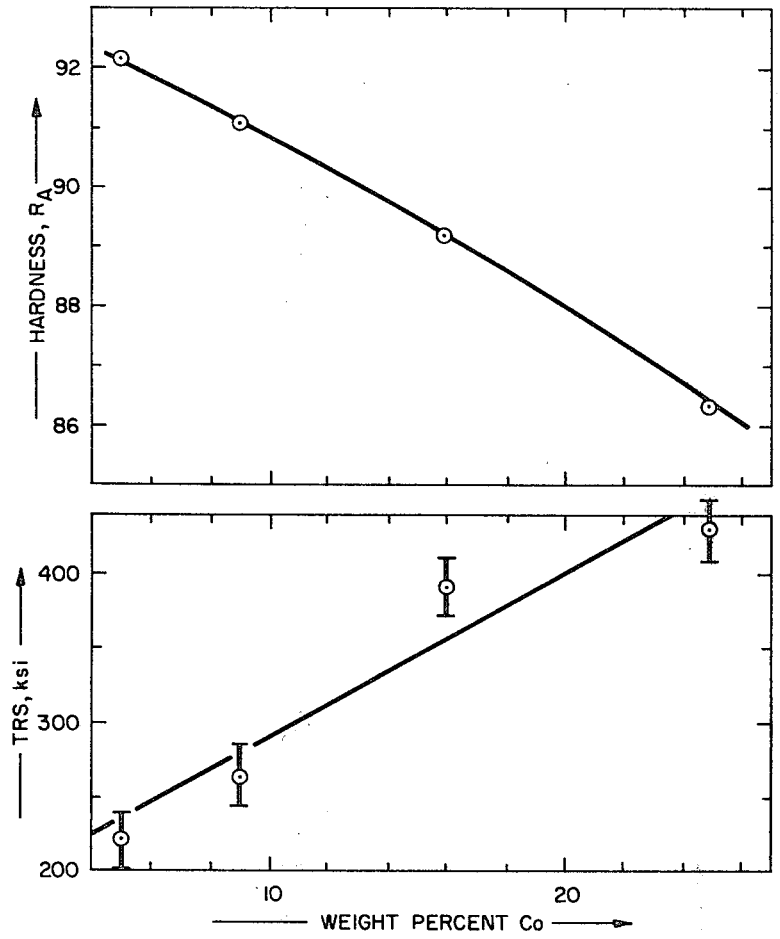
FIG. 12 is a graphical representation of the Rockwell A hardness and the bending strength of tools in accordance with the present invention as a function of the binder content.

FIG. 12 shows the hardness and bending strength of the solid solution $(Mo_{.8}W_{.2})C$ having an average grain size of 2.5 to 3 microns, as a function of the cobalt content.

It is seen from the curves of FIGS. 8 through 12 and Tables 1 through 4, that properties and performance of the tools fabricated from the alloys of the invention compare favorably with the prior art tools based on tungsten carbide, and consideration of their lower density provides a further economic advantage. With comparable grain structures, the molybdenum-based steel cutting grades show better thermal deformation resistance than commercial carbides designed for similar applications and grain growth stability during sintering was found to be significantly better than of the tungsten carbide materials.

The following Table 5 contains test data for a number of tools prepared from specific compositions within the range of the (Mo,W)C solid solution in accordance with the present invention when subjected to Test Condition A. Table 6 contains test data for a number of alloyed carbide tools prepared from compositions in accordance with the present invention when subjected to Test Condition B. Table 7 contains a list of the compositions of the prealloyed carbide ingredients used in the fabrication of the alloys listed in Table 6.

Table 5

Selected List of Molybdenum-Tungsten-Based Monocarbide Solid Solutions, Cemented with Various Binder Alloys. Test Condition A.

| Gross Composition Carbide Component, (Mole Fractions) | Binder | $t_f$* | $t_c$** | Def.*** | Remarks |
|---|---|---|---|---|---|
| $(Mo_{.75}W_{.25})C$ | 1.53 Mo, 8.47 Co. | 6 | 6 | — | Traces of excess $M_2C$ |
| $(Mo_{.75}W_{.25})C$ | 1.53 Mo, 8.47 Ni | 6 | 6 | — | " |
| $(Mo_{.75}W_{.25})C$ | 2 W, 9 Co | 5.8 | 6 | — | " |
| $(Mo_{.5}W_{.5})C$ | 7.80 Ni | 7 | 6 | — | — |
| $(Mo_{.8}W_{.2})C$ | 9 Ni | 5 | 5 | — | — |
| $(Mo_{.8}W_{.2})C$ | 18 Ni | 3 | 4 | .001" | — |
| $(Mo_{.8}W_{.2})C$ | 24 Ni | n.d. | n.d. | n.d. | — |
| $(Mo_{.25}W_{.75})C$ | 6.80 Ni | 5.6 | 6.5 | — | — |
| $(Mo_{.82}W_{.18})C$ | 6 Ni, 1 W | 7 | 10 | — | — |
| $(Mo_{.65}W_{.35})C$ | 15 Ni, 2 W | 4 | 4 | .0005" | — |
| $(Mo_{.8}W_{.2})C$ | 35 Fe | n.d. | n.d. | n.d. | Brittle, not dense |
| $(Mo_{.75}W_{.25})C$ | 6.75 Ni, 2.25 Fe | 6 | 6 | — | — |
| $(Mo_{.75}W_{.25})C$ | 5.85 Ni, 3.15 Fe | 2 | 3 | — | Light Porosity |
| $(Mo_{.75}W_{.25})C$ | 2.25 Ni, 6.75 Fe | 3 | n.d. | — | Brittle, some porosity |
| $(Mo_{.75}W_{.25})C$ | 4.50 Ni, 2.70 Co, 1.80 Fe | 6 | 6 | — | |
| $(Mo_{.75}W_{.25})C$ | 4.50 Co, 4.50 Fe | 5 | 6 | — | |
| $(MO_{.25}W_{.75})C$ | 3.50 Ni, 2.10 Co, 1.40 Fe | 6 | 6 | — | — |
| $(Mo_{.74}W_{.24}Ti_{.02})C$ | 9 Co | 7 | 6.8 | — | — |
| $(Mo_{.70}W_{.30})C$ | 45 Co | 0.4 | n.d. | n.d. | Chip welding |
| $(Mo_{.82}W_{.18})C$ | 24 Co | 2 | 4 | .0005" | Deformation at corner |
| $(Mo_{.74}W_{.24}Ti_{.02})C$ | 9 Ni | 6.5 | 6 | — | — |
| $(Mo_{.75}W_{.25})C$ | 10 Fe | n.d. | n.d. | n.d. | Brittle, $M_2C$-carbides |
| $(Mo_{.64}W_{.35}V_{.0})C$ | 9 Co | 7.6 | 6.5 | — | — |
| $(Mo_{.64}W_{.35}Ta_{.01})C$ | 9 Co | 6.2 | 6 | — | — |
| $(Mo_{.75}W_{.25})C$ | 8 Ni, 1 Cu | n.d. | 4 | — | Chip welding |
| $(Mo_{.75}W_{.25})C$ | 7.8 Ni, 2.2 Cu | n.d. | n.d. | n.d. | Chip welding |
| $(Mo_{.75}W_{.25})C$ | 5.85 Ni, 1.80 Fe, 1.35 Cu | 4 | n.d. | n.d. | Chip welding |
| $(Mo_{.75}W_{.25})C$ | 8.37 Co, .63 Cu | 6.2 | 6 | — | Slight chip welding |
| $(Mo_{.8}W_{.2})C$ | 2.0 Co, 3.5 Ni, 4.5 Cu | n.d. | n.d. | n.d. | Chip welding |
| $(Mo_{.8}W_{.2})C$ | 2.5 Co, 4.5 Ni, 3.0 Cu | n.d. | n.d. | n.d. | Chip welding |

Table 5-continued

Selected List of Molybdenum-Tungsten-Based Monocarbide Solid Solutions, Cemented with Various Binder Alloys. Test Condition A.

| Gross Composition Carbide Component, (Mole Fractions) | Binder | $t_f$* | $t_c$** | Def.*** | Remarks |
|---|---|---|---|---|---|
| $(Mo_{.9}W_{.10})C$ | 10 Ni | 5.8 | 5.5 | — | — |
| $(Mo_{.95}W_{.05})C$ | 3 Co, 2 Ni, 5 Cu | n.d. | n.d. | n.d. | |
| MoC | 10 Ni | n.d. | n.d. | n.d. | Not dense |
| MoC | 10 Co | n.d. | n.d. | n.d. | Not dense |
| MoC | 2 Co, 2 Ni, 6 Cu | — | — | — | Severe chip welding |
| MoC | 9 Cu, 1 Ni | n.d. | n.d. | n.d. | Not dense |
| MoC | 9 Cu, 1 Co | n.d. | n.d. | n.d. | Chip welding |
| MoC | 5 Cu, 5 Fe | n.d. | n.d. | n.d. | Chip welding |
| MoC | 10 Fe | n.d. | n.d. | n.d. | Very brittle |

*Minutes cutting time to reach .010" flank wear
**Minutes cutting time to reach .003" crater depth
***Edge or corner deformation after 3 minutes cutting time, inches.

Table 6

Selected List of Alloyed Carbide Grades for Steel-Cutting Applications. Test Condition B.

| Input Carbides* | Gross Composition of Carbide | Binder Wt. % | $t_f$** | $t_c$*** | Remarks |
|---|---|---|---|---|---|
| A + G + Ta | $(Ti_{.24}Ta_{.10}W_{.50}M_{.16})C$ | 9 Co | 9 | 5.5 | — |
| A + G + TaC | $(Ti_{.24}Ta_{.10}W_{.50}Mo_{.16})C$ | 9.2 Ni, 1.8 Mo | 10 | 6.2 | — |
| A + G + $(Hf_{.5}Nb_{.5})C$ | $(Ti_{.24}Hf_{.05}Nb_{.05}W_{.50}M_{.16})C$ | 9.2 Co | 12 | 9.2 | — |
| A + G + $(Hf_{.5}Ta_{.5})C$ | $(Ti_{.24}Hf_{.05}Ta_{.05}W_{.50}Mo_{.16})C$ | 9.2 Co | 10 | 6.8 | — |
| C + F + G + TaC | $(Ti_{.24}Ta_{.10}W_{.41}Mo_{.25})C$ | 10 Co | 9 | 5.4 | |
| F + D + TaC | $(Ti_{.24}Ta_{.10}W_{.36}Mo_{.30})C$ | 10 Ni, 1 Mo | 11 | 6.0 | — |
| A + B + F + TaC | $(Ti_{.24}Ta_{.10}W_{.26}Mo_{.40})$ | 11.5 Co | 8 | 4.5 | Light porosity |
| C + E + TaC | $(Ti_{.24}Ta_{.10}W_{.16}Mo_{.50})C$ | 12.2 Co | 8 | 5.0 | — |
| F + D + $(Hf_{.5}Ta_{.5})C$ | $(Ti_{.24}Hf_{.05}Ta_{.05}W_{.36}Mo_{.30})C$ | 10.5 Ni | 11 | 5.8 | — |
| F + D + HfC | $(Ti_{.24}Hf_{.10}W_{.36}Mo_{.30})C$ | 11 Ni | 10 | 8.5 | Light chipping |
| F + C + TaC | $(Ti_{.24}Ta_{.05}W_{.41}Mo_{.30})C$ | 10.5 Co | 6 | 4.0 | Slight deformation |
| B + C + G + TaC | $(Ti_{.33}Ta_{.10}W_{.42}Mo_{.15})C$ | 5.2 Co | 21 | 12 | — |
| A + B + G + TaC | $(Ti_{.33}Ta_{.10}W_{.37}Mo_{.20})C$ | 5.5 Co | 19 | 12 | — |
| E + B + B + TaC | $(Ti_{.33}Ta_{.10}W_{.27}Mo_{.30})C$ | 5.8 Co | 20 | 11 | — |
| A + B + G + $(Ta_{.5}Hf_{.5})C$ | $(Ti_{.33}Ta_{.05}Hf_{.05}W_{.37}Mo_{.20})C$ | 5.2 Co | 20 | 13 | — |
| A + B + G + $(Hf_{.5}Nb_{.5})C$ | $(Ti_{.33}Nb_{.05}Hf_{.05}W_{.37}Mo_{.20})$ | 6 Ni, 1 W | 21 | 14 | — |
| C + D + G + TaC | $(Ri_{.48}Ta_{.12}W_{.35}Mo_{.05})C$ | 12 Co | 16 | 13 | — |
| B + C + G + NbC | $(Ti_{.48}Nb_{.12}W_{.25}Mo_{.15})C$ | 13 Co | 11 | 12 | — |
| B + C + G + TaC | $(Ti_{.48}Ta_{.12}W_{.25}Mo_{.15})C$ | 12 Ni, 3 Mo | 14 | 17 | — |
| A + E + G + TaC | $(Ti_{.24}Ta_{.10}W_{.36}Mo_{.30})C$ | 55 Ni, 5.5 Co | 8 | 5.0 | — |
| F + D + TaC | $(Ti_{.24}Ta_{.10}W_{.36}Mo_{.30})C$ | 7.5 Ni, 3 Fe | 8 | 5.0 | — |
| F + D + TaC | $(Ti_{.24}Ta_{.10}W_{.36}Mo_{.30})C$ | 5.5 Ni, 3 Co, 2 Fe | 10 | 5.0 | — |
| A + E + TaC | $(Ti_{.24}Ta_{.10}W_{.10}Mo_{.56})C$ | 14 Fe | n.d. | n.d. | Brittle |
| F + C + $(Hf_{.5}Nb_{.5})C$ | $(Ti_{.20}Hf_{.05}Nb_{.05}W_{.35}Mo_{.35})C$ | 10 Ni, 1 Mo | 10 | 7.0 | — |
| F + C + $(Hf_{.5}Nb_{.5})C$ | $(Ti_{.20}Hf_{.05}Nb_{.05}W_{.35}Mo_{.35})C$ | 10.5 C | 9 | 7.0 | — |
| E | $(Mo_{.8}W_{.2})C$ | 10 Co | 18 | >30 | Coated with 11μ TiN |
| E | $(Mo_{.8}W_{.2})C$ | 10 Ni | 12 | 18 | Coated with 5.6μ TiC |
| F | $(Mo_{.5}W_{.5})C$ | 8 Co | 21 | >30 | Coated with 21μ TiN |
| Commercial C-5 | $(Ti_{.24}Ta_{.10}W_{.66})C$ | 8.5 Co | 8 | 4.5 | — |
| Commercial C-7 | $(Ti_{.33}Ta_{.10}W_{.57})C$ | 4.8 Co | 22 | 11 | — |

*Compositions of input carbides A through G, See Table 7
**$t_f$ = Minutes cutting time to reach .008" flank wear
***$t_c$ = Minutes cutting time to reach .004" crater depth Table 7

Compositions of Input Carbides used in the Fabrication of Steel-Cutting Carbide Grades.

| Designation | Composition |
|---|---|
| A | $(Ti_{.60}Mo_{.40})C_{.98}$ |
| B | $(Ti_{.60}W_{.10}Mo_{.30})C_{.985}$ |
| C | $(Ti_{.60}W_{.15}Mo_{.15})C_{.99}$ |
| D | $(Ti_{.76}W_{.24})C_{.99}$ |
| E | $(Mo_{.8}W_{.2})C$ |
| F | $(Mo_{.5}W_{.5})C$ |
| G | WC |

The compositions of the present invention are formed from carbide master alloys and eventual addition carbides, with a binder selected from metals of the iron group, in particular nickel and cobalt; the binder alloy also may contain smaller alloys additions of certain refractory metals, such as molybdenum, tungsten, and chromium, for attaining improved binder properties, and of certain addition metals, such as copper, which sometimes are added to lower the melting temperature of the binder and thus to facilitate fabrication of certain compositions at lower temperatures.

The binder content of the alloys of the invention is dependent upon the intended application and may vary between about 3 and 50 percent by weight of the composition for the unalloyed grades, i.e., cemented (Mo,W)C solid solutions, and between 4 and 20 weight percent for the alloyed types which are primarily intended for tools for machining steel. In general, toughness and strength increase with increasing binder content, but hardness, wear-resistance, but in particular thermal deformation resistance, decreases.

Selection of the proper binder alloy is additionally dependent upon the gross composition of the tool alloy, grain structure and the desired characteristics of the sintered compacts. In unalloyed carbide grades, the strength of nickel-bonded alloys is usually 15 to 20% less than of alloys cemented with cobalt when prepared by sintering under hydrogen or vacuum, and their hardness is also somewhat lower. When sintered under nitrogen, the bending strengths of the nickel-bonded alloys approach those with cobalt binders; the strengths of cobalt-bonded (Mo,W)C solid solutions generally were found to decrease when sintered under nitrogen.

In the alloyed, steel-cutting, carbide grades, a cobalt binder is preferable for tungsten-rich compositions because of higher strength and thermal deformation resistance when compared with nickel-bonded grades. At higher molybdenum exchanges, however, tools bonded with nickel, or nickel-molybdenum alloys, generate less friction and heat at the tool-work piece interface when machining steels and thus have better tool life than tools with cobalt binder.

The properties of the carbide-binder metal composites of the invention can further be extensively modified by choice of gross composition of the hard alloy phase and the compositions of the different carbide ingredients. The following summary of the effects of the principal alloying ingredients are based on observations of their fabrication characteristics, measured properties, and on performance studies of the composites as tool materials in turning 4340 steel. However, low level alloying with other elements can also be accomplished without departing from the spirit of the invention.

1. Increased substitution of molybdenum for tungsten in alloyed, steel cutting, carbide grades improves wear performance, but somewhat decreases thermal shock resistance of the composite, as such substitutions tend to increase the relative amount of cubic carbide in the composite. Binder consisting of Ni-Mo alloys are preferable for steel-cutting grades containing high molybdenum contents because of the better toughness and crack propagation resistance of such tools when used in milling steels.

2. In iron metal cemented (Mo,W)C alloys, grain size distribution in the sintered compact is largely determined by the grain size distribution of the powders in the as-milled condition, since only very limited grain growth can be achieved even under prolonged heat treatment at sintering temperatures. Significant grain growth was observed only in compacts containing binder additions of lower melting metals, such as copper.

3. Partial substitution of chromium for molybdenum and tungsten in the carbide, or chromium additions to the binder, decreases toughness and strength of the sintered composites, but improves oxidation resistance.

4. Prolonged exposure of carbon-deficient, unalloyed, grades to temperatures less than 1000° C. causes embrittlement of the sintered alloy as a result of precipitation of Mo-rich subcarbide at the binder-monocarbide interface. The precipitation carbide can be eliminated by a solution treatment of the sintered part of 1250° to 1300° C. followed by rapid cooling to room temperature.

5. Low level additions of vanadium, titanium and titanium carbide to cemented unalloyed grades did not have a pronounced effect on strength and wear performance, but further enhanced grain growth stability during sintering.

6. Partial substitution of hafnium, or hafnium and niobium, for tantalum in the addition carbides improves crater resistance of the alloys.

7. The behavior of cemented (Mo,W)C solid solution and molybdenum-containing, alloyed carbide grades as substrates for wear-resistance coatings, such as oxides, nitrides, and carbides, is similar to the corresponding molybdenum-free grades, and the performance of the coated inserts in cutting steel is also equivalent.

The data shown in the above-discussed tables and graphs are representative of many other alloys within the range of the invention which were prepared and tested. It becomes evident from a comparison of the performance and physical property data, that the alloys of the invention offer a substantial improvement in cost performance of the cemented carbides of the state of the art designed for similar applications.

As was noted above, some of the data is for cutting tools formed from the unalloyed grade (Mo,W)C plus binder material, which is given only for comparison purposes to comparable WC plus binder. As is well known to those skilled in the art, one of the principal fields of use of such compositions is in wear resistance applications such as dies, linings, mining and drilling tools, etc. Those skilled in the art are aware that compositions for such applications usually have significantly higher binder metal content than do cutting tools.

While the invention is thus disclosed and with many embodiments described in detail, it is not intended that the invention be limited to those shown embodiments. Instead, many embodiments and uses will occur to those skilled in the art which fall within the spirit and scope of the invention. It is intended that the invention be limited only by the appended claims.

What is claimed is:

1. The method of forming a solid solution of hexagonal tungsten monocarbide and molybdenum monocarbide of stoichiometric composition containing between 10 and 100 mole percent molybdenum monocarbide, comprising the steps of:

forming an intimately blended mixture of the desired gross composition, heating the mixture to a temperature within the stability domain of cubic $(Mo,W)C_{1-x'}$ lowering the temperature of the mixture to a temperature within the stability domain of hexagonal (Mo,W)C to cause the nucleation of hexagonal (Mo,W)C from cubic $(Mo,W)C_{1-x'}$ and maintaining the temperature of the mixture at the lower temperature for a sufficient amount of time until the formation of the hexagonal (Mo,W)C is complete.

2. The method of claim 1 in which the mixture is heated to a temperature of at least 2000° C.

3. The method of claim 1 in which up to 4 atomic percent of a diffusion aiding metal is added to the mixture prior to heating.

4. The method of claim 3 in which the diffusion aiding metal is an iron group metal.

5. The method of claim 4 in which the diffusion aiding metal is selected from the group consisting of nickel and cobalt and comprises from 0.5 to 10.0% by weight of the mixture.

6. The method of forming a solid solution of hexagonal tungsten monocarbide and molybdenum monocarbide of stoichiometric composition containing between 10 and 100 mole percent molybdenum monocarbide, comprising the steps of:

forming an intimately blended mixture of the desired gross composition, heating the mixture to a temperature within the stability domain of pseudo cubic $(MO,W)_3C_2$, lowering the temperature of the mixture to a temperature within the stability domain of hexagonal (Mo,W)C to cause the nucleation of hexagonal (Mo,W)C from pseudo cubic $(Mo,W)_3C_2$, and maintaining the temperature of the mixture at the lower temperature of a sufficient amount of time until the formation of the hexagonal (Mo,W)C is complete.

7. The method of claim 6 in which the mixture is heated to a temperature of at least 1700° C.

8. The method of claim 6 in which up to 4 atomic percent of a diffusion aiding metal is added to the mixture prior to heating.

9. The method of claim 8 in which the diffusion aiding metal is an iron group metal.

10. The method of claim 9 in which the diffusion aiding metal is selected from the group consisting of nickel and cobalt and comprises from 0.5 to 1.0% by weight of the mixture.

* * * * *